US006160354A

United States Patent [19]

Ruvinskiy et al.

[11] Patent Number: 6,160,354

[45] Date of Patent: Dec. 12, 2000

[54] LED MATRIX CURRENT CONTROL SYSTEM

[75] Inventors: Boris Ruvinskiy, Framingham; William H. Watts, Harvard, both of Mass.

[73] Assignee: 3COM Corporation, Santa Clara, Calif.

[21] Appl. No.: 09/358,676

[22] Filed: Jul. 22, 1999

[51] Int. Cl.[7] ..... G09G 3/10

[52] U.S. Cl. ..... 315/169.3; 315/169.2; 345/82; 345/44; 345/46

[58] Field of Search ..... 315/169.1, 169.2, 315/169.3; 340/811, 800, 362; 345/82, 45, 46, 47, 48, 49

[56] References Cited

U.S. PATENT DOCUMENTS 3,740,570 6/1973 Kaelin et al. ..... 307/40
4,962,375 10/1990 Hirane et al. ..... 340/782
4,967,192 10/1990 Hirane et al. ..... 340/811
5,138,310 8/1992 Hirane et al. ..... 340/811
5,751,263 5/1998 Huang et al. ..... 345/82
6,014,119 1/2000 Staring et al. ..... 345/82

*Primary Examiner*—Don Wong
*Assistant Examiner*—Trinh Vo Dinh
*Attorney, Agent, or Firm*—McGlew and Tuttle, P.C.

[57] ABSTRACT

A system for controlling the current supplied to an LED array includes an LED register which sends out individual signals to enable respective LED's. A plurality of drivers are provided, whose outputs are tied together and supply the power to the LED array. A plurality of logic blocks controls the enablement of the plurality of drivers. Each logic block is in communication with the LED register to determine a number of LED's enabled. Each logic block enables a respective driver depending on a number of the LED's enabled.

9 Claims, 3 Drawing Sheets

LED MATRIX CURRENT CONTROL SYSTEM

FIELD OF THE INVENTION

The present invention relates to a system for controlling the current being fed to a plurality of LED's (light emitting diodes). In particular the present invention relates to a system where the current is varied according to the number of LED's which are enabled.

BACKGROUND OF THE INVENTION

In the field of displays, LED's are often used to convey information regarding the status of a device. This is especially true in the field of computer networks, where the status of different parts of the network are represented by whether or not an LED within a display is enabled or lit-up. Therefore the number of LED's that are enabled or lit at any one time can vary from zero to the maximum number of LED's. The amount of current needed to drive the display, therefore also changes. Providing a current supply which is variable from practically zero when no LED's are enabled, to the maximum current needed to enable all the LED's, can be expensive and difficult to incorporate. This is especially true when the display device is substantially all digital logic.

Also, very often a plurality of LED's are arranged in a matrix arrangement with a plurality of rows and columns. In order to simplify the selection of individual LED's, one terminal of each LED in a row is connected together. The second terminal of the LED's in a column are also connected together. In order to enable a specific LED, the row of first terminals and the column of second terminals for that specific LED are energized. To further simplify operation of the LED matrix, the rows are energized sequentially and only the columns having LED's to be lit, are enabled. If a variable current supply is used to power the rows, it must be very quickly and efficiently switched and varied sequentially through the rows. The structure for performing this operation is an added expense.

SUMMARY AND OBJECTS OF THE INVENTION

It is the primary object of the present invention to provide structure providing current to an LED array, where the number of LED's enabled is variable. It is also an object of the present invention to provide this current with structure that is simple in design, efficient in operation and inexpensive in cost.

The present invention accomplishes this object by providing a plurality of drivers, preferably digital drivers. The drivers can be enabled and disabled, and in the enabled state, the drivers supply a current on an output terminal. A plurality of these drivers are provided and their outputs are tied together and fed to one row of the LED's.

Each driver has a logic block which is in communication with an LED register array that controls the enabling and disabling of the individual LED's. Each logic block determines which LED's are enabled and then uses internal logic to determine whether its respective driver should be enabled. In the preferred embodiment, the number of LED's enabled determines whether or not a particular logic block will enable its corresponding driver.

In a further preferred embodiment, each driver is enabled when the number of LED's enabled is greater than a different predetermined value. The number of drivers, and respective logic blocks, is preferably less than the number of LED's controlled. The output of the drivers provides a range of current during their enablement, with a maximum of that range being greater than a current required by one of the LED's for enablement. In this way, the number of drivers does not have to equal the number of LED's.

As an example, a first driver is enabled when the number of enabled LED's is greater than zero. A second driver is enabled when the number of LED's enabled is greater than one. A third driver is enabled when the number of enabled LED's is greater than three, and a fourth driver is enabled when the number of enabled LED's is greater than five. This example is preferably used when the number of LED's is six with each LED requiring approximately 20 milli amps.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
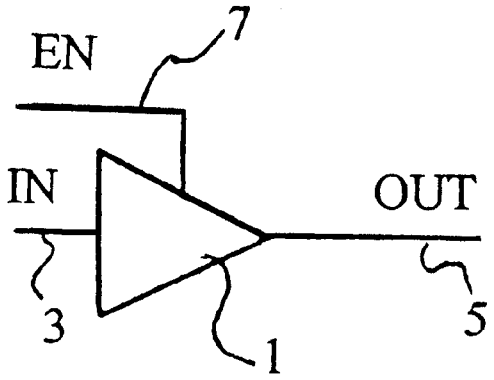
FIG. 1 is a schematic diagram of a driver.

Referring to the figures, and particularly FIG. 1, a driver 1 has an input 3 and an output 5. The driver 1 also has an enable terminal 7. The driver is preferably an output driver of a field programmable gate array (FPGA). When the enable line 7 is equal to a "logical 1" the driver sends the signal from the in line 3 to the out line 5. The signal provided on the output line 5 provides a current according to the device specification for the driver, and covers a standard range for driving other logical devices. When enable line 7 is at a "logical zero" the output line 5 has no signal and no current, and is at high impedance.

Figure 2:
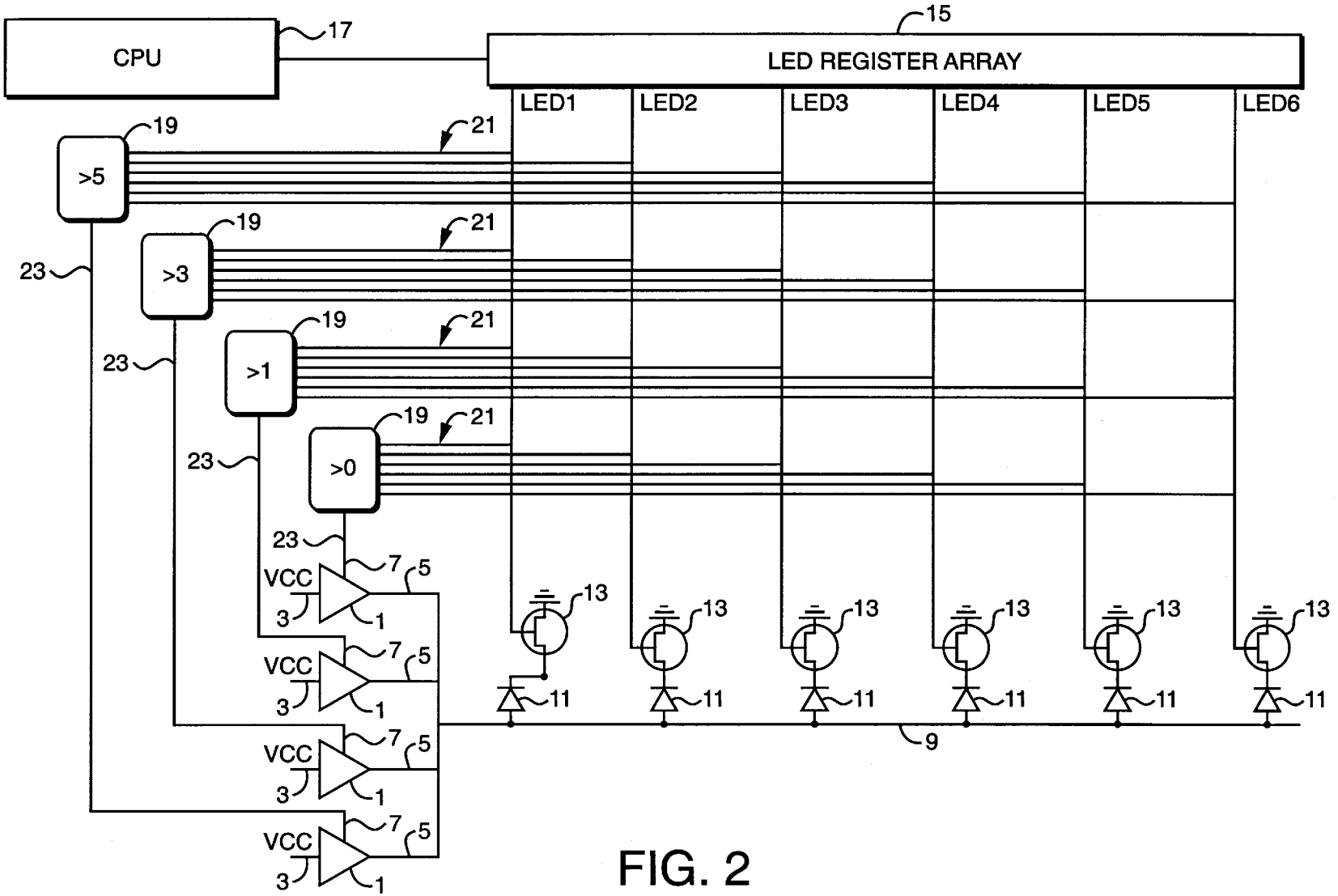
FIG. 2 is a schematic diagram of the programmable current LED display for a row.

As shown in FIG. 2, a voltage VCC is applied to input line 3 of the drivers 1. The output lines 5 of all of the drivers 1 are connected together and are fed to a row 9 of LED's 11. The LED's 11 have one terminal connected to the row 9, and the other end are connected to solid state switches 13 which are controlled by LED register array 15. In an alternative, the second terminal of the LED's 11 can be connected directly to the LED register array 15 if the logic structure of LED register array 15 is sufficient to energize the LED's 11 with the current from the drivers 1.

The LED register array 15 receives a signal from the CPU 17 indicating which LED's 11 are to be enabled or eliminated. The LED register array then sends individual signals to either the switch 13 or the second terminal of the LED 11 to energize the respective LED's.

Logic blocks 19 have input lines 21 which connect to the lines between the LED register array 15 and the LED's 11. The logic blocks 19 also have output blinds 23 which connect to the enable lines 7 of the drivers 1. The logical blocks 19 send a logical one to the corresponding driver 1 depending on a number of the LED's that are enabled. As shown in the drawings, the logical block 19 labeled ">0"

sends a logical 1 to enable line 7 of the corresponding driver 1 whenever the number of LED's enabled is greater than 0. Likewise the logical block 19 labeled ">1" sends a logical 1 to the corresponding driver 1 whenever the number of LED's enabled is greater than 1. The logical block labeled ">3" sends a logical 1 when the number of LED's enabled is greater than 3, and likewise for the logical block labeled ">5". The drivers 1 according to the configuration of the present invention provide sufficient current to drive all the LED's 11 in the row 9 in an efficient manner and with readily available components.

The output drivers 1, and the logical blocks 19 can all be incorporated into one FPGA. It is also possible to include the LED register array 15 into the FPGA. This allows both the control, and the power supply to the LED's 11, to be in one single compact unit which is both readily available, and compatible with other digital circuitry in the display, and in the device on which the display is mounted. In the preferred embodiment an FPGA manufactured by ALETRA CORPORATION, 101 Innovation drive, San Jose, Calif. 95134, as model number EPF6016TC144-3 is used. Data sheets describing this device are attached as an appendix to this application. Different FPGA's from different manufacturers can also be used and still use the basic ideas of the present invention, namely the use of drivers to power the LED's and control blocks to control and vary the power to the LED's based on a number of LED's lit.

The logic for each of the logic blocks 19 to give the logical relationship between the input lines 21 and the output lines 23 can be written in many different forms and still retain the proper relationship. An example of logical equations for the logic blocks are as follows:

Logic block ">0"=LED 1 or LED 2 or LED 3 or LED 4 or LED 5 or LED 6;

Logic block ">1"=(LED 1 and LED 2) or (LED 1 and LED 3)
or (LED 1 and LED 4) or (LED 1 and LED 5)
or (LED 1 and LED 6) or (LED 2 and LED 3)
or (LED 2 and LED 4) or (LED 2 and LED 5)
or (LED 2 and LED 6) or (LED 3 and LED 4)
or (LED 3 and LED 5) or (LED 3 and LED 6)
or (LED 4 and LED 5) or (LED 4 and LED 6)
or (LED 5 and LED 6);

Logic block ">3"=(LED 1 and LED 2 and LED 3 and LED 4)
or (LED 1 and LED 2 and LED 3 and LED 5)
or (LED 1 and LED 2 and LED 3 and LED 6)
or (LED 1 and LED 2 and LED 4 and LED 5)
or (LED 1 and LED 2 and LED 4 and LED 6)
or (LED 1 and LED 2 and LED 5 and LED 6)
or (LED 1 and LED 3 and LED 4 and LED 5)
or (LED 1 and LED 3 and LED 4 and LED 6)
or (LED 1 and LED 3 and LED 5 and LED 6)
or (LED 1 and LED 4 and LED 5 and LED 6)
or (LED 2 and LED 3 and LED 4 and LED 5)
or (LED 2 and LED 3 and LED 4 and LED 6)
or (LED 2 and LED 3 and LED 5 and LED 6)
or (LED 2 and LED 4 and LED 5 and LED 6)
or (LED 3 and LED 4 and LED 5 and LED 6);

Logic block ">5"=LED 1 and LED 2 and LED 3 and LED 4 and LED 5 and LED 6.

Figure 3:
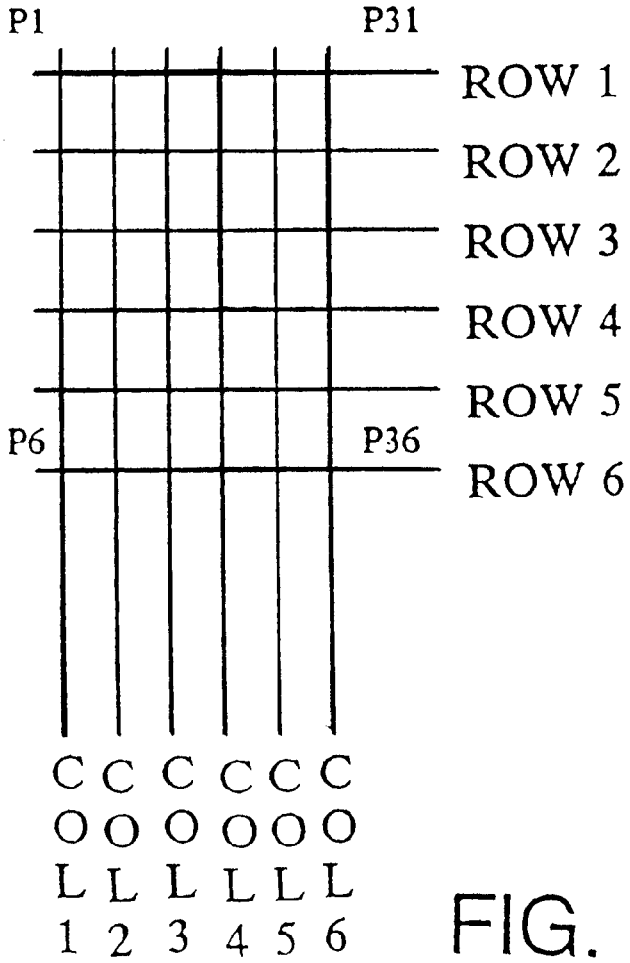
FIG. 3 is a schematic diagram of an LED matrix.
Figure 4:
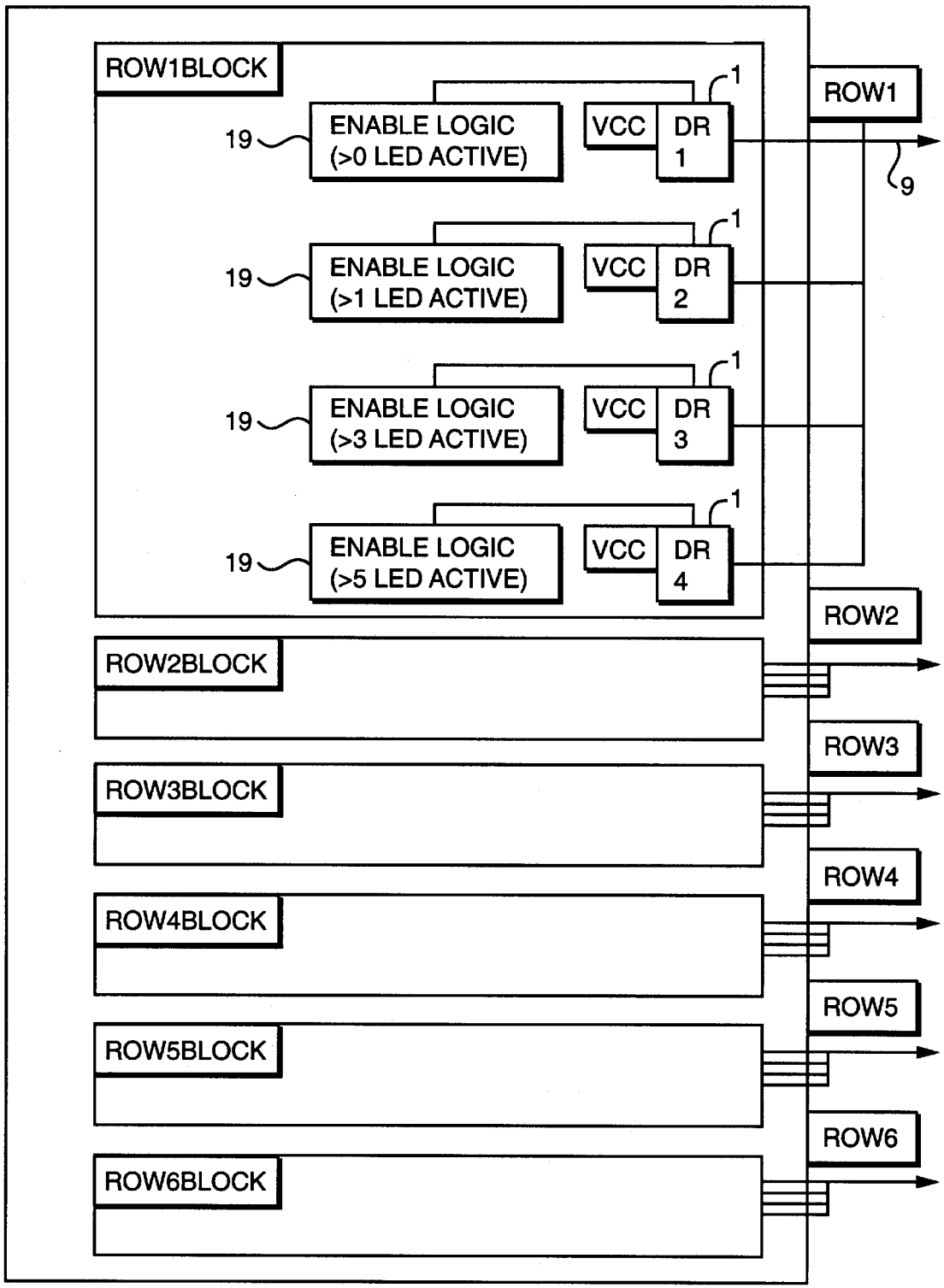
FIG. 4 is a schematic diagram of the LED current control system for a matrix of LED's.

As shown in FIG. 3, LED's, represented by points "p1. . . p36", are often arranged in matrix form in row and columns. In such applications, the circuitry of FIG. 2, in particular the drivers 1, the logic blocks 19 and the LED's 11 are repeated row after row. This is shown in FIG. 4. It is also quite possible, and efficient to have all the circuitry for each row combined together in a single FPGA.

While the present invention uses six LED's in a row, and four drivers power these LED's, the present invention is not limited to six LED's, or the ratio of four drivers per six LED's. The number of LED's can vary depending on the application, and the number of drivers depends on the relative current characteristics of the LED's and the drivers. Different FPGA's may have different current characteristics and therefore the ratio of drivers to LED's may change. Also the actual logic equations determining when to enable the drivers can vary depending on the relative current characteristics of the LED's and drivers.

While specific embodiments of the invention have been shown and described in detail to illustrate the application of the principles of the invention, it will be understood that the invention may be embodied otherwise without departing from such principles.

What is claimed is:

1. An LED array current control system comprising:

an LED register array individually controllable of an enablement of a plurality of LED's;

a plurality of drivers, each of said drivers having an output connected together and then connected to the plurality of LED's for powering the plurality of LED's;

a plurality of logic blocks, each of said plurality of logic blocks controlling enablement of one of said plurality of drivers, said each logic block being in communication with said LED register array to determine a total number of the LED's enabled at one time, said each logic block enabling a respective said driver depending on a number of the LED's to be enabled.

2. The system in accordance with claim 1, wherein:

said each logic block enables said respective driver depending on a different number of the LED's to be enabled.

3. The system in accordance with claim 1, wherein:

said each logic block enables said respective driver when greater than a predetermined number of the LED's are to be enabled.

4. The system in accordance with claim 3, wherein:

said predetermined number is different for each of said logic blocks.

5. The system in accordance with claim 1, wherein:

a number of said plurality of drivers is less than a number of the plurality of LED's controlled by said LED register array at any one time.

6. The system in accordance with claim 1, wherein:

said output of said drivers provide a range of current during said enablement, said range having a maximum greater than a current required by one of the LED's for enablement.

7. The system in accordance with claim 6, wherein:

said maximum is less than twice said current required by one of the LED's for enablement.

8. The system in accordance with claim 4, wherein:

a number of said plurality of drivers is less than a number of the plurality of LED's;

said output of said drivers provide a range of current during said enablement, said range having a maximum greater than a current required by one of the LED's for enablement, said maximum is less than twice said current required by one of the LED's for enablement.

9. An LED array current control system comprising:

an LED register array individually controllable of an enablement of a plurality of LED's;

a plurality of drivers, each of said drivers having an output connected together and then connected to the plurality of LED's for powering the plurality of LED's;

a plurality of logic blocks, each of said plurality of logic blocks controlling enablement of one of said plurality of drivers, said each logic block being in communication with said LED register array to determine a number of the LED's enabled, said each logic block enabling a respective said driver depending on a number of the LED's to be enabled, said each logic block enables said respective driver depending on a different number of the LED's to be enabled.

* * * * *